United States Patent [19]

Leroy

[11] 4,171,216

[45] Oct. 16, 1979

[54] PROCESS FOR REFINING NON-FERROUS MATTE

[75] Inventor: Pierre J. Leroy, St. Germain en Laye, France

[73] Assignee: Creusot-Loire, Paris, France

[21] Appl. No.: 899,257

[22] Filed: Apr. 24, 1978

[30] Foreign Application Priority Data

Apr. 25, 1977 [FR] France ..... 77 12455

[51] Int. Cl.[2] ..... C22B 15/06

[52] U.S. Cl. ..... 75/76; 75/77; 75/78

[58] Field of Search ..... 75/77, 78, 60, 76

[56] References Cited

U.S. PATENT DOCUMENTS

| | | | |
|---|---|---|---|
| 3,817,744 | 6/1974 | Leroy | 75/60 |
| 4,073,646 | 2/1978 | Kryczum | 75/76 |

*Primary Examiner*—P. D. Rosenberg

*Attorney, Agent, or Firm*—Robert D. Yeager

[57] ABSTRACT

A process for refining molten non-ferrous matte by injecting an oxidizing gas into the matte through at least one multiple, concentric tube tuyere submerged beneath the surface of the matte. The tuyere is cooled by injecting liquid sulfur through the outermost tube of the tuyere.

8 Claims, No Drawings

PROCESS FOR REFINING NON-FERROUS MATTE

BACKGROUND OF THE INVENTION

1. Field of the Invention

This invention relates to the refining of Mattes of non-ferrous metals, such as Mattes of copper, nickel, cobalt or lead.

2. Description of the Prior Art

The refining of molten mattes of non-ferrous metals, which mattes generally comprise iron sulfides and the sulfides of non-ferrous metals, is traditionally carried out in refractory-lined converters by blowing ordinary air or air slightly enriched with oxygen into the matte through single tube tuyeres embedded in the converter below the surface of the matte. The blast blown through the tuyeres cannot be enriched beyond about 36% of oxygen, however, without causing rapid erosion of the tuyeres and the surrounding refractory.

Workers in the art have recognized the desirability of increasing the oxygen content of the blast but this objective has only recently been achieved with the development of metallurgical processes employing multiple, concentric tube tuyeres which are protected against erosion by the injection of liquid or gaseous cooling agents through the outermost tubes of such tuyeres; refining agents and/or other additives are blown through the central or other inner tubes of the tuyeres. The liquid cooling agents blown in these new tuyeres include water, carbon dioxide in the liquid state, liquid hydrocarbons such as fuel oil, and the like. Exemplary of these multiple concentric tube tuyeres and their operation is U.S. Pat. No. 3,817,744 whose teachings are incorporated herein be reference. The tuyere disclosed in that patent comprises two concentric tubes but it is understood that, depending upon the metallurgical process involved, more than two concentric tubes advantageously may be used to form a tuyere.

U.S. Pat. No. 3,990,890 discloses a process for refining molten copper matte by means of a double tuyere which is cooled by the injection therethrough of a cooling agent. In one embodiment of the process disclosed in that patent, the cooling agent is a carbon-containing material, preferably fuel oil. In the process of U.S. Pat. No. 3,990,890, as well as in any process for refining non-ferrous metal matte, the atmosphere in the converter consists essentially of sulfur dioxide ($SO_2$), also called sulfurous anhydride, and when nitrogen is present in the blast, nitrogen will also be present in the converter atmosphere. The component of principal interest in the atmosphere is, however, the $SO_2$ produced by the oxidation reaction in the matte refining process.

In practicing the known non-ferrous matte refining processes, this $SO_2$ atmosphere is contaminated by the introduction of other substances through the tuyeres, such as the carbon-containing material in the process of U.S. Pat. No. 3,990,890. To the extent that one wishes to produce by-products from the off gases, especially sulfuric acid, the presence of contaminants in those gases complicates such production because they cause the $SO_2$ content of the off-gases to fluctuate.

SUMMARY OF THE INVENTION

The present invention overcomes the shortcomings of the known non-ferrous matte refining processes by reducing or avoiding the presence of contaminants in the atmosphere of the converter during the major part of the treatment of the matte. The present invention provides, in a process for refining molten non-ferrous matte by injecting an oxidizing gas into the matte through at least one multiple, concentric tube tuyere submerged beneath the surface of the matte, while also injecting a cooling agent through the outermost tube of the tuyere, the improvement comprising injecting liquid sulfur as the cooling agent. In order to assure that the sulfur is in a liquid and highly fluid state upon injection, the liquid sulfur is introduced into the outermost tube of the tuyere at a temperature in the range of 120° C. to 150° C. If desired, the liquid sulfur may be emulsified with steam prior to injection.

The improved process of the present invention further comprises passing a fluid through the passageway of the outermost tube of the tuyere immediately before and immediately after the liquid sulfur injection, the fluid being at a sufficiently elevated temperature to effectively prevent the sulfur from solidifying within the passageway. Preferably, the fluid is selected from the group consisting of steam and hot air.

The present invention further provides that the liquid sulfur being injected as the cooling agent be replaced by a sulfur-free fluid when the sulfur content of the matte reaches about 6% by weight. The purpose of this replacement is to avoid the further introduction of sulfur into the converter at a time when the refining process requires a reduction in the partial pressure of $SO_2$ in the converter atmosphere.

The present invention further comprises a process for refining molten non-ferrous matte in a refractory-lined converter having at least one multiple, concentric tube tuyere submerged beneath the surface of the molten bath, which process comprises: injecting a refining agent into the matte through an inner tube of the tuyere while injecting liquid sulfur through the outermost tube of the tuyere until the sulfur content of the matte diminishes to about 6% by weight, the refining agent being an oxidizing gas; and thereafter decreasing the oxygen content of the refining agent by an amount effective to lower the partial pressure of $SO_2$ present in the converter. Preferably, the oxygen content of the refining agent is decreased by adding thereto at least one diluent selected for the group consisting of inert gas, steam and atomized water.

Other features and advantages of the present invention will become apparent from the following detailed description.

DESCRIPTION OF THE PREFERRED EMBODIMENT

According to the invention, a double tuyere having two concentric tubes may be used to inject the refining gas and liquid sulfur cooling agent, respectively, into the non-ferrous matte. Illustrative of such a tuyere is one in which the inner tube has an inner diameter of 15 millimeters and an outer diameter of 21 millimeters. The outer tube has an inner diameter of 21.2 millimeters and an outer diameter of 27 millimeters. With these dimensions, the annular gap formed by the two tubes is about 0.1 millimeters in width. The inner tube is centered in the outer tube by means of longitudinal ridges, each having a radial height of about 0.1 millimeters.

These tuyeres are installed in a horizontal cylindrical converter of the Pierce-Smith type in a manner described in U.S. Pat. No. 3,990,890 whose teachings are incorporated by reference herein. The tuyeres are suitably connected to pipes for the supply of ordinary air, pure oxygen and steam to the tuyeres' central tubes, and of liquid sulfur and steam to the tuyeres' outer tubes.

In carrying out the present invention, liquid sulfur which is preheated and liquified by any well known means is introduced into the outer tubes of the tuyeres at a temperature in the range of 120° C. to 150° C.; in this temperature range, the sulfur is liquid and exhibits a high degree of fluidity. Just prior to introduction of the liquid sulfur, the circuit through which the liquid sulfur flows is brought to a suitably elevated temperature by passing therethrough a hot fluid such as, for example, steam or hot air. The circuit likewise is flushed and purged with such hot fluid immediately after sulfur injection is stopped. The purpose of these preheating and flushing operations, respectively, is to prevent sulfur from solidifying within the circuit upon introduction and to prevent any cooling of the circuit in the presence of residual liquid sulfur, either of which would lead to the deposition of solidified sulfur and a resultant blocking of the circuit.

Depending upon the heat conditions, the liquid sulfur is introduced into the outermost tube of each tuyere under a pressure of 20 to 40 bars, and at a rate of 0.5 liters to 1 liter per minute per tuyere. The liquid sulfur is used as the protective agent for the tuyeres from the beginning of the refining of the non-ferrous metal matte, during the entire iron removal phase, and during a major portion of the desulfurization phase, until the sulfur content of the molten matte has diminished to about 6%. Below this level, the liquid sulfur cooling agent is replaced by a sulfur-free cooling agent, for example, steam, for reasons described below.

A major advantage of the use of liquid sulfur as the cooling agent for the tuyeres is that all of the advantages of tuyere protection by liquid cooling agents are preserved, while at the same time disturbance of the atmosphere of the converter is reduced or avoided. That is, with respect to the latter point, the liquid sulfur volatilizes at least in part with the remainder going into solution in the matte. All of the injected sulfur is then oxidized to form $SO_2$, the component of the converter atmosphere that is of principal interest in the subsequent production of useful by-products such as sulfuric acid. As to the former point, protection of the tuyere against wear at elevated temperatures is provided by the cooling effect caused both by the volatization of the sulfur and by heating it to the temperature of the matte.

The oxidation of the sulfur into $SO_2$, which constitutes an exothermic reaction, does not occur near the tip of the tuyere because at the tip of the tuyere the oxidizing gas and the liquid sulfur are separated by the matte as a result of the tuyere being submerged in the matte. Under these conditions, the tuyere cannot operate as a burner. The cooling effect only occurs at the tip portion of the tuyere. The heating effect of the oxidation reaction of the sulfur to form $SO_2$ takes place further away from the tuyere tip, within the matte. The heating effect therefore improves the heat balance of the refining operation.

The $SO_2$, formed from the sulfur being injected through the tuyeres, is added to the atmosphere of the converter, which contains $SO_2$ originating from the refining reactions of the matte. Thus, the composition of the gases emitted by the converter is not disturbed by the agent for protecting the tuyeres, and the recovery of the $SO_2$ from these fumes, either for manufacturing sulfuric acid or for any other use, is still possible under conventional conditions.

It is only when the sulfur content of the matte is low that it is appropriate to replace the liquid sulfur by another fluid that is sulfur-free for protecting the tuyere. The dissociation products or combustion products of the other fluid aid in reducing the partial pressure of $SO_2$ in the atmosphere of the converter, and hence of promoting the desulfurization reaction in the matte. However, this replacement of protective agents is useful only at low sulfur contents.

The present invention will be further understood by reference to the following non-limiting example: The objective is to refine a copper matte containing 29% of iron, 29% of copper and 31% of sulfur to obtain 10 tons of "blister" or impure copper. The refining operation generally is carried out in accordance with the process described in U.S. Pat. No. 3,990,890.

Fifteen tons of copper matte are charged into the converter, together with an appropriate amount of cooling additions for copper, and a suitable amount of silica for the formation of a slag. The silica, ground into particles having dimensions of 70–80 millimeters, is injected into the converter by means of air under pressure, e.g. using an air gun.

The blowing of oxidizing gas then begins: pure oxygen is supplied to the central tube of each tuyere under a pressure of 10 bars for a few minutes, in order to raise the temperature of the matte rapidly from 1250° C. to the optimum temperature of about 1350° C. The oxygen content of the oxidizing gas is then reduced to 85% of oxygen by introducing ordinary air into the pure oxygen, and blowing is continued for a period of 30 to 40 minutes depending on the refining conditions estimated by the operator.

Blowing is then interrupted, and the slag of iron silicate is raked out into a slag tub. The mouth of the converter is cleaned. Immediately before and after each blowing period, the circuits through which liquid sulfur flows are flushed with hot fluid as described above.

Thirteen tons of liquid matte, containing 29% of iron, 29% of copper and 31% of sulfur, are now charged into the converter. Blowing is resumed under the same conditions as in the preceding period; at the conclusion of the blowing period, the iron silicate slag is raked out.

If necessary, a third blowing period is provided, which third period is shorter than either of the two preceding periods, in order to achieve a sufficiently low iron content of the matte.

In the present operation, the total duration of the actual tool blowing time for the iron removal phase (oxidation of the iron) was 1 hour 45 minutes and included three blowing periods. "White metal", from which the iron has been removed but which is not yet desulfurized, is obtained.

The desulfurization phase is then begun and completed in a single blowing period because no intermediate deslagging is necessary. Blowing is carried out without any addition of cooling solids, either with pure oxygen under a pressure of 10 bars, or with a mixture of oxygen and steam (for atomized water), in such a way as to fully control the temperature of the matte and to keep it at about 1350° C. to 1360° C. When the sulfur content of the matte is reduced to about 6%, that is to say about 15 minutes before the end of the blow, the proportion of steam is increased and the proportion of pure oxygen is reduced. This desulfurization phase lasts a total of 75 minutes.

During the entire iron removal phase, and during the desulfurization phase to the point where the sulfur content of the matte is about 6%, each tuyere is cooled by a flow rate of liquid sulfur of about 0.6 liters per minute per tuyere. As a result, for a period of 105 minutes during iron removal and 60 minutes during desulfurization (a total of 165 minutes), the consumption of liquid sulfur is: $0.6 \times 165 \times 7 = 693$ liters.

For the last 15 minutes of the desulfurization phase, during which the sulfur content of the matte changes from about 5 to 6% to less than 1%, the liquid sulfur is replaced by steam introduced into the outer tube of each of the tuyeres, so as to reduce the partial pressure of $SO_2$ in the atmosphere of the converter, and to promote the desulfurization reaction, which becomes more difficult at low sulfur contents of the matte.

During the entire operation, 28 tons of copper matte and 18 tons of cold additions were charged into the converter, in order to produce 10 tons of impure (blister) copper. Thus for each ton of copper produced, 69 liters of sulfur were consumed. A total of 20 tons of slag was produced and raked out. The total duration of the operation, from one casting to the next, was 4 hours 15 minutes.

What is claimed is:

1. In a process for refining molten non-ferrous matte by injecting an oxidizing gas into said matte through at least one multiple, concentric tube tuyere submerged beneath the surface of said matte, while also injecting a cooling agent through the outermost tube of said tuyere, the improvement comprising:

injecting liquid sulfur as said cooling agent.

2. The improvement recited in claim 1 wherein:

said liquid sulfur is introduced into said outermost tube at a temperature in the range of 120° C. to 150° C.

3. The improvement in claim 1 or 2 wherein:

said liquid sulfur is emulsified with steam prior to said injection.

4. The improvement recited in claim 1 or 2 wherein:

said liquid sulfur is replaced by a sulfur-free fluid when the sulfur content of said matte reaches about 6% by weight.

5. The improvement recited in claim 1 or 2, which further comprises:

passing a fluid through the passageway of said outermost tube immediately before and immediately after said liquid sulfur injection, said fluid being at a sufficiently elevated temperature to effectively prevent said sulfur from solidifying within said passageway.

6. The improvement recited in claim 2 wherein:

said fluid is selected from the group consisting of steam and hot air.

7. A process for refining molten non-ferrous matte in a refractory-lined converter having at least one multiple, concentric tube tuyere submerged beneath the surface of said molten bath, which process comprises:

injecting a refining fluid into said matte through an inner tube of said tuyere while injecting liquid sulfur through the outermost tube of said tuyere until the sulfur content of said matte diminishes to about 6% by weight, said refining fluid being an oxidizing gas; and thereafter decreasing the oxygen content of said refining agent by an amount effective to lower the partial pressure of $SO_2$ present in said converter.

8. A process as recited in claim 7 wherein:

the oxygen content of said refining agent is decreased by adding thereto at least one dilution selected from the group consisting of inert gas, steam and atomized water.

* * * * *

UNITED STATES PATENT AND TRADEMARK OFFICE

CERTIFICATE OF CORRECTION

PATENT NO. : 4,171,216

DATED : October 16, 1979

INVENTOR(S) : PIERRE J. LEROY

It is certified that error appears in the above-identified patent and that said Letters Patent are hereby corrected as shown below:

Column 1, line 35, "be" should be --by--.

Column 4, line 51, "tool" should be --total--.

Column 4, line 61, "for" should be --or--.

Column 6, line 16, claim 6, "in claim 2" should be -- in claim 5 --.

Signed and Sealed this

*Thirteenth* Day of *May 1980*

[SEAL]

*Attest:*

SIDNEY A. DIAMOND

*Attesting Officer*

*Commissioner of Patents and Trademarks*